US010358840B2

(12) United States Patent
Hiner et al.

(10) Patent No.: US 10,358,840 B2
(45) Date of Patent: Jul. 23, 2019

(54) T-POST ELECTRIC FENCE INSULATING DEVICES

(71) Applicant: Lock Jawz LLC, Georgetown, IN (US)

(72) Inventors: Nicholas Andrew Hiner, Georgetown, IN (US); Alan Wade Simon, Portland, TN (US)

(73) Assignee: LOCK JAWZ LLC, Georgetown, IN (US)

( * ) Notice: Subject to any disclaimer, the term of this patent is extended or adjusted under 35 U.S.C. 154(b) by 190 days.

(21) Appl. No.: 15/703,924

(22) Filed: Sep. 13, 2017

(65) Prior Publication Data

US 2018/0073269 A1 Mar. 15, 2018

Related U.S. Application Data

(60) Provisional application No. 62/394,735, filed on Sep. 14, 2016.

(51) Int. Cl.

| | |
|---|---|
| ***E04H 17/12*** | (2006.01) |
| ***E04H 17/04*** | (2006.01) |
| ***H01B 17/14*** | (2006.01) |
| ***H01B 17/24*** | (2006.01) |
| ***E04H 17/06*** | (2006.01) |

(52) U.S. Cl.

CPC ..... *E04H 17/12* (2013.01); *E04H 17/04* (2013.01); *E04H 17/06* (2013.01); *H01B 17/145* (2013.01); *H01B 17/24* (2013.01)

(58) Field of Classification Search

CPC ..... E04H 17/10; E04H 17/12; E04H 12/24; A01K 3/005; H01B 17/14; H01B 17/145

See application file for complete search history.

(56) References Cited

U.S. PATENT DOCUMENTS

| | | | | | |
|---|---|---|---|---|---|
| 2,437,344 | A | * | 3/1948 | Behlmann | H01B 17/145 174/161 F |
| 3,652,780 | A | * | 3/1972 | Wilson | H01B 17/145 174/163 F |
| 3,654,383 | A | * | 4/1972 | Wilson | H01B 17/145 174/163 F |
| 3,820,758 | A | * | 6/1974 | Berg, Jr. et al. | A01K 3/005 174/163 F |
| D243,342 | S | | 2/1977 | Langlie et al. | |
| D243,343 | S | | 2/1977 | Berg, Jr. et al. | |
| 4,028,489 | A | | 6/1977 | Berg, Jr. et al. | |
| 4,040,604 | A | | 8/1977 | Langlie et al. | |
| 4,061,873 | A | | 12/1977 | Berg, Jr. et al. | |
| 4,077,611 | A | * | 3/1978 | Wilson | A01K 3/005 174/163 F |
| D248,644 | S | | 7/1978 | Berg, Jr. et al. | |
| D248,645 | S | | 7/1978 | Langlie et al. | |
| D248,851 | S | | 8/1978 | Langlie et al. | |

(Continued)

*Primary Examiner* — Daniel J Wiley

(74) *Attorney, Agent, or Firm* — Scott Houtteman; Houtteman Law LLC

(57) ABSTRACT

A T-post insulator that includes means to attach in a plurality of locations around the post. The insulator portion of the device consists of an outer surface that wraps around the T-post about 270 degrees for optimal insulation of the wire. The wire is installed through means of a snap in action from the top center of the wire around a retaining post. The wire is insulated fully regardless if installed on a straight run or a corner installation where wrapping around the T-post is required.

12 Claims, 4 Drawing Sheets

(56) References Cited

U.S. PATENT DOCUMENTS 4,263,477 A 4/1981 Wilson, Sr.
4,520,231 A * 5/1985 Hubbell ..... H01B 17/145 174/158 F
4,580,767 A 4/1986 Zimmerman
4,599,488 A 7/1986 Wilson, Jr.
4,623,756 A * 11/1986 Wilson, Jr. ..... H01B 17/145 174/158 F
4,642,940 A * 2/1987 Ettema ..... A01G 17/14 47/44
4,680,428 A * 7/1987 Wilson, Jr. ..... H01B 17/145 174/158 F
4,845,317 A * 7/1989 Wilson, Jr. ..... H01B 17/145 174/163 F
4,866,218 A 9/1989 Wilson, Jr.
4,883,923 A 11/1989 Langlie et al.
4,905,968 A 3/1990 Eby et al.
4,965,413 A 10/1990 Langlie et al.
4,982,932 A * 1/1991 Baker ..... E04H 17/12 174/154
5,032,693 A 7/1991 Langlie et al.
5,046,705 A * 9/1991 Williams ..... E01F 7/02 256/36
5,063,274 A 11/1991 Johnson
5,096,162 A 3/1992 Cleveland
D330,008 S 10/1992 Berg et al.
D331,221 S 11/1992 Langlie et al.
D347,823 S 6/1994 Berg et al.
5,412,158 A * 5/1995 Yearwood ..... A01K 3/005 174/158 F
5,920,036 A * 7/1999 Egger ..... A01K 3/005 174/161 F
5,959,255 A 9/1999 Langlie et al.
D416,859 S * 11/1999 Langlie ..... D13/129
6,353,187 B1 * 3/2002 Wilson, Jr. ..... A01K 3/005 174/158 F
6,380,490 B1 4/2002 Gaston
6,489,569 B1 12/2002 Thomson
D474,152 S 5/2003 Burdick
6,563,055 B1 * 5/2003 Burdick ..... H01B 17/145 174/138 G
6,583,363 B1 * 6/2003 Wilson, Jr. ..... H01B 17/145 174/158 F
6,619,627 B2 9/2003 Salisbury et al.
6,872,892 B1 3/2005 Burdick
6,960,728 B1 * 11/2005 Halderman ..... H01B 17/145 174/158 F
D535,616 S 1/2007 Halderman
7,915,536 B1 3/2011 Hackett
8,123,155 B2 2/2012 Petty
8,507,799 B2 8/2013 Johnson et al.
D690,265 S 9/2013 Nelson
8,697,999 B2 4/2014 Thiem
9,142,337 B2 9/2015 Nelson
9,521,827 B2 * 12/2016 Houston ..... A01K 3/005
D789,185 S 6/2017 Wall

* cited by examiner

T-POST ELECTRIC FENCE INSULATING DEVICES

This application claims the benefit of Provisional Patent Application Ser. No. 62/394,735 filed on Sep. 14, 2016, the contents of which are hereby incorporated by reference in their entirety.

BACKGROUND

Field of the Invention

The present invention relates to an electric fence insulating device. Electric fences are used on farms to contain animals. In a typical electrified fence, the horizontal wire carries the charge and must be insulated from ground. The fence post is typically grounded, literally pounded into the ground, and so insulators are necessarily placed in between the charged horizontal wire and the grounded vertical fence post. The present invention is an improvement over the previous electric fence insulating devices.

Description of the Related Art

Regular insulators connect to only one part of the T-post and do not provide adequate insulation for the electric wire. The prior art T-post insulators are generally rod shaped and extend perpendicularly from the fence post and/or have one or more "claw" structures to engage the electric wire.

Insulators designed for T-posts are not well suited for corners that use T-posts and do not provide sufficient insulation for the electric wire when making turns.

Insulators designed for T-posts only attach to the post in one direction and are not well suited for posts that are not driven into the ground at the correct angle. Also these insulators are often time consuming to install. Certain steps: e.g. crimping, nailing, screwing etc. are required to secure each insulator to the fence post.

Also, there are no insulators that can attach to the T-post in multiple orientations and that can provide adequate insulation for both straight runs and corners.

SUMMARY OF THE INVENTION

The insulator described in this application can be adopted for use with any size or shape fence post. A preferred fence post, however, is the T-post and a preferred embodiment will fit 1.25-1.33# T-posts.

The insulators of this invention have a generally semicircular shaped body with an outer surface and an inner surface. The outer surface is generally convex shaped and designed to contact an electrically charged wire. The outer surface wraps around a fence post from about 180 degrees to about 300 degrees, preferably about 270 degrees. This allows the insulator to provide adequate insulation at a number of locations along the fence, including both straight runs and corner installations. In a preferred embodiment, the outer surface will have a structure configured to hold the horizontal wire.

The insulator has a generally concave shaped inner surface which contains various structures that allow the insulator to from a friction fit around the post. Specifically, the insulators are designed to wrap around the post with the inner surface designed to securely engage with the fence post. In particular, it engages with standard studded T-posts such that the insulator is held at a fixed height on the fence post in many different orientations.

Installation is faster and more convenient than installation of insulators previously on the market.

DETAILED DESCRIPTION

Figure 1B:
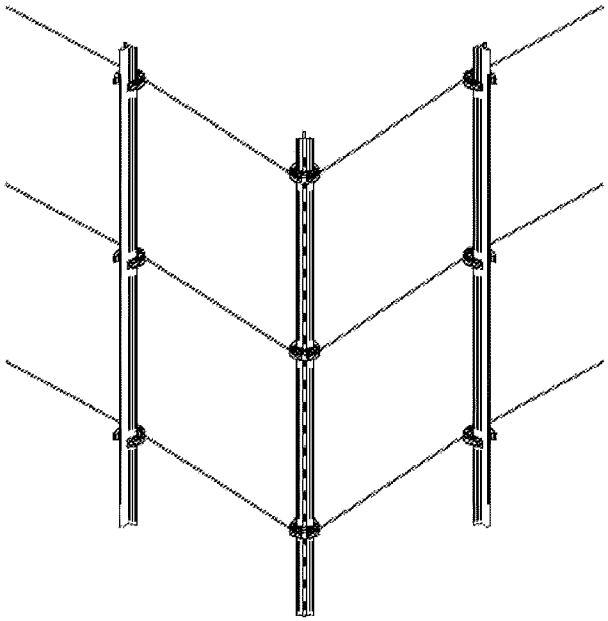
FIGS. 1A-B are interior and exterior views, respectively, of a common configuration of electrified fencing system showing the T-post insulators in place on both a straight run and corner posts.

The following defines a preferred embodiment of the invention and is not meant to limit the invention in any way. The invention can have the particular structures illustrated in the various self-explanatory figures submitted as part of this application but these are only some of the preferred embodiments that will function.

The term "generally semicircular shaped body" does not define any specific geometric shape. The preferred embodiments illustrated here, smooth crescents, are chosen for purely aesthetic reasons. The body can be any shape that wraps around a fence post and both engages the post so as to stay in place and provides a surface for the electrified wire to rest, insulated from the fence post, and functional in both straight run fence lines and corners. Accordingly, smooth curved sides, irregularly curved sides and both regular and irregular polygons can function equally well and should be included with the term "generally semicircular shaped body"

Similarly, the term "generally convex outer surface" does not correspond to any particular shape. The outer surface must merely wrap around the fence post and cover enough of the fence post to provide adequate insulation when installed both on straight fence runs and in corners as well as a variety of irregular fence lines.

The term "generally concave inner surface" does not correspond to any particular shape. The inner surface must simply wrap around the circumference of the fence post to a sufficient degree so as to engage structures extending out of opposite sides of the fence post, such as the side wings that extend out of opposite sides of a T-post.

The terms "insulator," "insulator device" and "insulating device" are used interchangeably in this specification. This invention comprises an insulator with an inner surface and an outer surface as explained above.

The terms "vertical" and "horizontal" as used, for example in the phrases "vertical fence post" "horizontal groove" and "horizontal electrified wire" are meant to distinguish the relative orientations of these structures, and are not meant as limiting the absolute orientation of these structures. The fence will function equally with the insulators installed in all orientations. Accordingly, if the electrified wires are orientated in a vertical direction, perhaps to protect a vertical space, the absolute orientation of certain "horizontal" structures will be vertical. Finally, the insulator will also function if installed "upside down."

When the fence is installed on uneven terrain certain fence posts may be orientated perpendicular to the ground but not be perpendicular in the absolute sense. Indeed, fence posts may be installed at various angles from the vertical for other reasons particular to the needs and preferences of the owner.

In addition, there is no need for the electrified wire to be perpendicular to the fence post, although this is the preferred embodiment. In cases where the fence post is not perpendicular to the electrified wire the terms "vertical" and "horizontal" are simply meant to indicate the fence post orientation and electrified wire orientation, respectively.

The insulators various "horizontal" and "vertical" structures are also meant to be relative. The insulator can obviously be mounted either horizontally or vertically as needed. Generally speaking, horizontal and vertical structures of the insulator are perpendicular. However, custom made insulators can be made, for example, for use on steeply graded land, in which the horizontal and vertical structures are skewed appropriately for use in these specific non-level terrains.

Figure 1A:
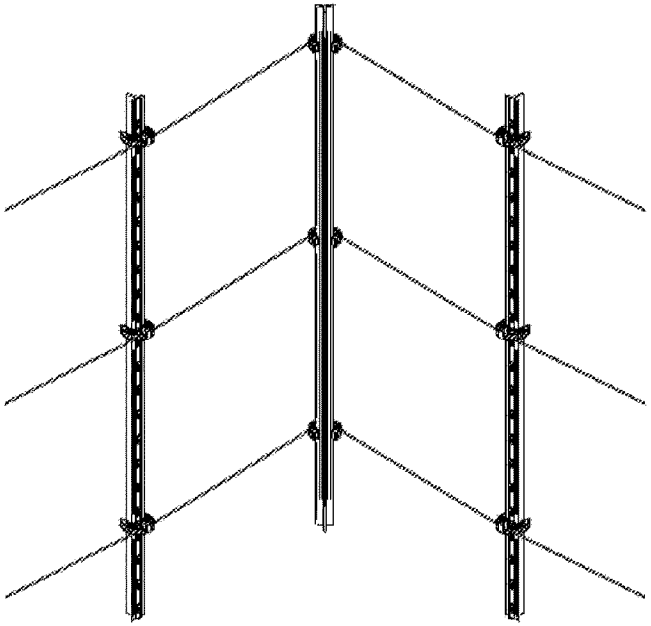
Figure 2:
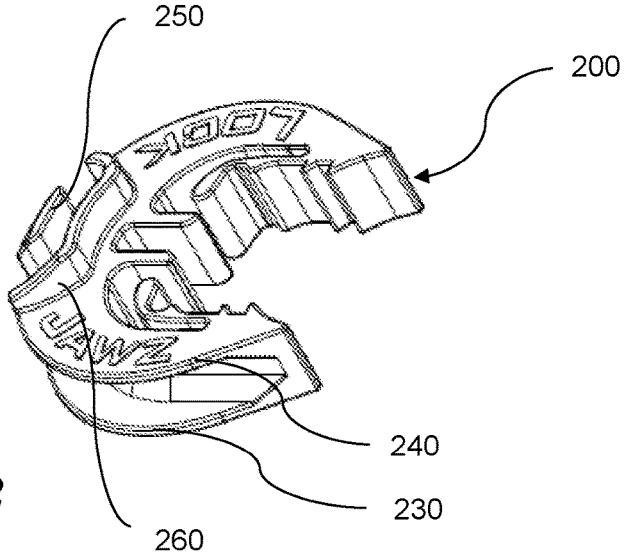
FIGS. 2 and 3 are perspective views of the T-post insulator.
Figure 3:
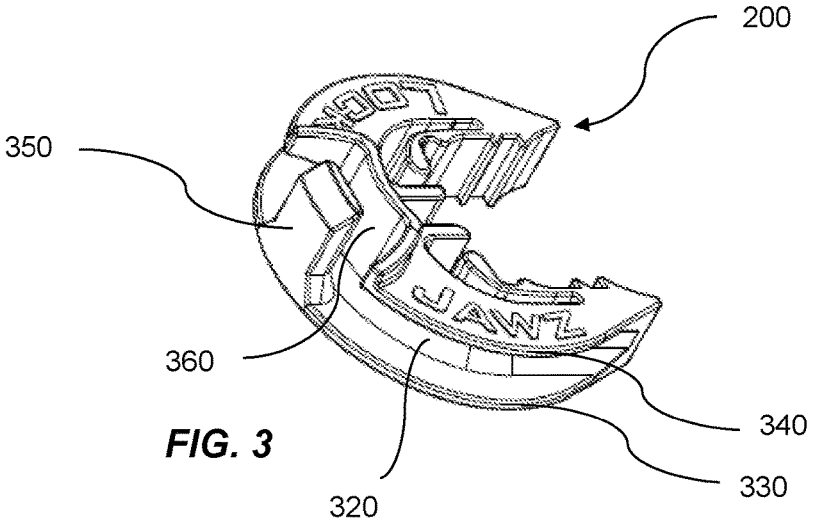
Figure 4:
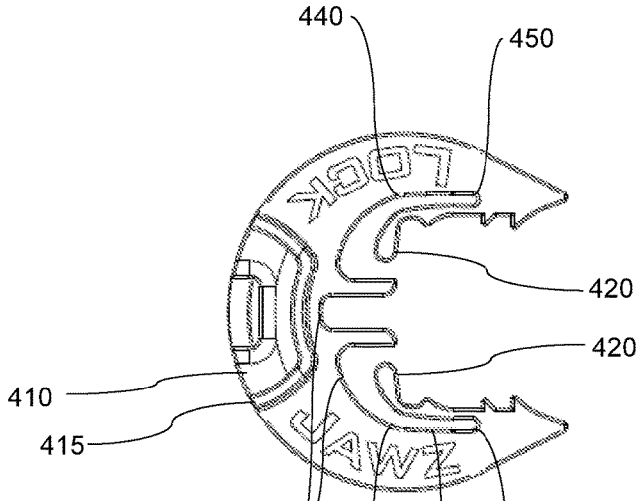
FIG. 4 is a top view of the T-post insulator.
Figure 5:
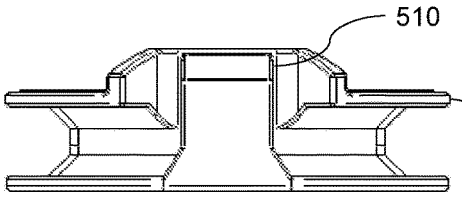
FIG. 5 is a side view of the insulator illustrating the side with a tooth.
Figure 6:
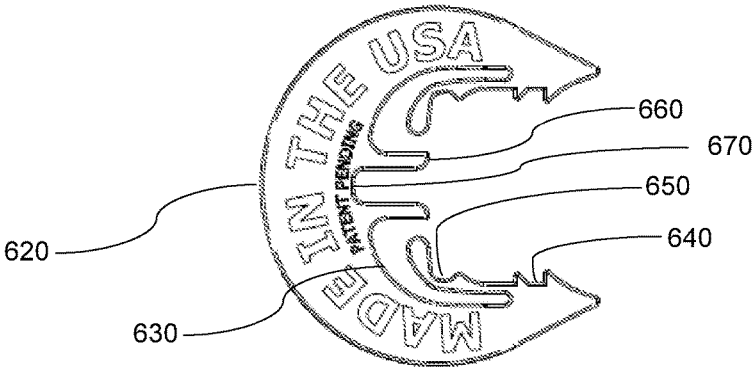
FIG. 6 bottom view of the T-post insulator.

Referring now to FIGS. 1A and 1B, this illustrates the interior view and exterior view of the insulators as installed in one common configuration. Note that the corner post use the same insulator as the posts on the straight run. In this embodiment, however, the corner post insulator is orientated facing outward so that the horizontal electrified wire contacts the insulator on the outside of the enclosure while the insulators along the straight runs are orientated to contact the wire on the interior of the enclosure.

The electrified wire can be any wire made of conducting material including, but not limited to, wires commonly in use at this time: aluminum steel, poly wire, poly rope and barbed wire.

The insulators can be used with all known electrical configurations including all voltages, both continuous and non-continuous power output and all other electronic parameters.

Referring now, variously, to FIGS. 2-6, in a preferred embodiment the insular 200 has a crescent shape. The outer surface 620 is convex and has a horizontal groove 320. The groove is formed between a first side wall 230, 330 and a second side wall 240, 340.

In another preferred embodiment, the insulator contains a tooth 250, 350 that rises out from the top 410 of the first side wall and extends toward the second side wall. In still another preferred embodiment, the area of the second side wall toward which the tooth extends is notched 360. In these embodiments, the tooth can extend into and beyond 510 the plane of that portion of second side wall 520 which was removed to form the notch. The edge 415 of the notch 360 can also have a lip 260. Preferably the lip extends perpendicularly from the second side wall in the direction opposite of the first side wall. The notch with and without the lip, works together with the tooth so that the electrified wire can be easily installed, through means of a snap in action, without reducing the insulation of the wire with respect to the fence post.

The crescent shaped insulator 200 also has a crescent shaped concave inner surface 630. The inner surface will have a set of strategically arranged structures that will function to engage a standard T-post in any of several orientations. These interior structures can be studs, bumps, teeth, wings, prongs slots or any number of well-known structures that can engage a T-post to form a friction fit. In a preferred embodiment, the inner surface wraps around the post from about 180 degrees to about 300 degrees, preferably about 180 degrees. In another preferred embodiment, the insulator forms a crescent covering about 270 degrees.

In another preferred embodiment the inner surface can be divided into two symmetric side regions (the areas around 440 and 450) and a middle region 430. The symmetric side regions 440, 450 are each adjacent to the ends of the crescent and they flank the middle region 430 located in between the two side regions. The side regions can be further subdivided into a forward portion 450 located near at the crescent opening and a rearward portion 440 ending at the middle region 430. In still another preferred embodiment, a prong structure 420 is provided that originates in the forward portion 450 of the side region and extends backward, roughly parallel to the walls 425 of the side region. The prong extends over the side region rearward portion 440 toward the middle region 430. In another preferred embodiment, the prong 420 is spring loaded so that it can form a friction fit with both 1.25 lbs/ft and 1.33 lbs/ft T-posts.

Still other preferred embodiments exist. The interior side of the prong can contains structures that contact the T-post to form a secure friction fit. Examples of these structures are a slot 650 located at an end of the prong that will engage the T-post and a slot 640 located near the base of the prong that will also engage the T-post.

Another option is to include a pair of a pair of wings 660 located in the middle region 430 of the interior surface and extending out perpendicularly from the middle region surface to form a middle channel 670.

FIGS. 7A-F and 8A-F illustrate how the various inner surface structures work together to provide for six (6) preferred configurations of attachment of the insulator to the T-post. In the first configuration, FIGS. 7A, 8A, the slots 650 located at the ends of the prong engages the T-post side wings while the middle channel 670 engages the studs. In the second configuration, FIGS. 7B, 8B, the middle channel 670 engages one of the T-post side wings. The slot 640 located near the base of one prong engages the other T-post side wing and the slot located at the base of the other prong engages the T-post spine.

Figures 7A, 7B, 7C, 7D, 7E, 7F, 8A, 8B, 8C, 8D, 8E, 8F:
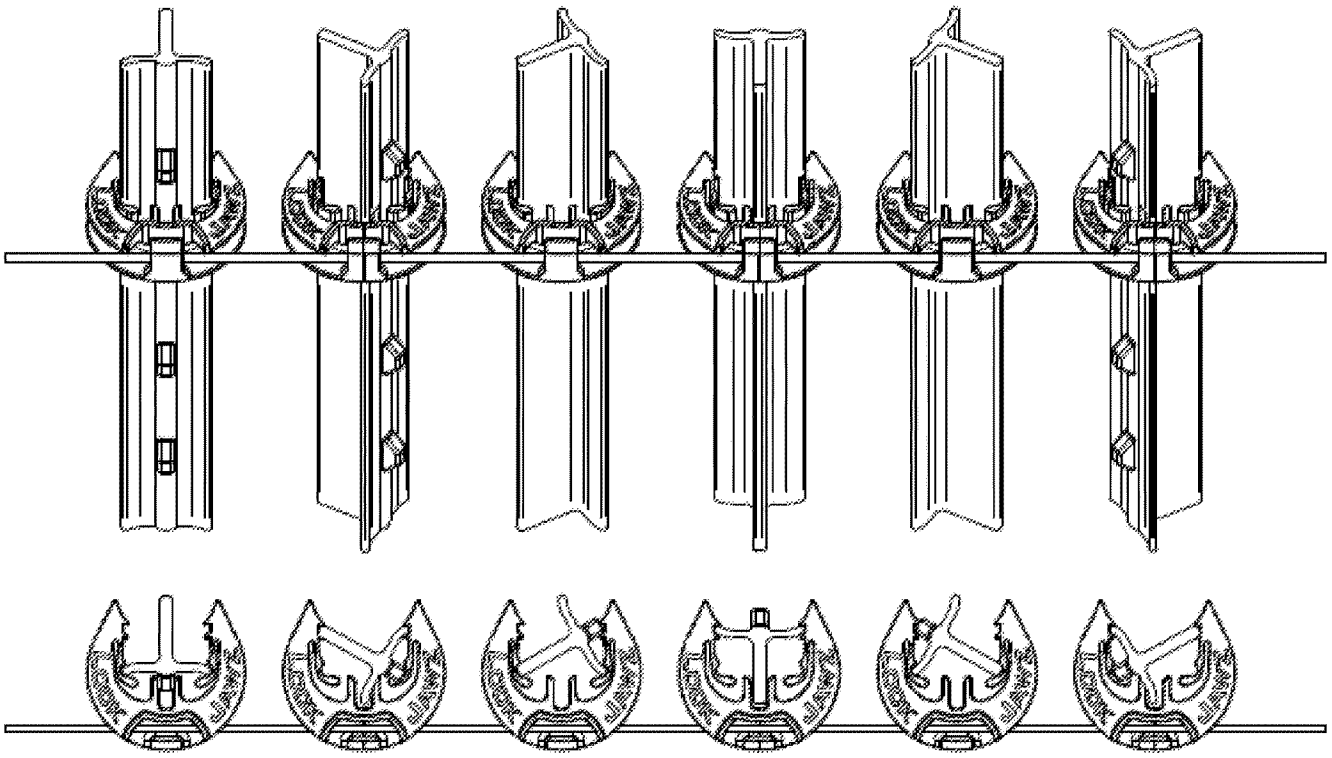
FIGS. 7A-F are perspective views illustrating six (6) different ways the insulator can be attached to a standard T-post.
FIGS. 8A-F are top views of the insulators illustrated in FIGS. 7A-F.

In the third configuration, FIGS. 7C, 8C, the slot 650 at the end of one prong engages one T-post side wing. The slot 640 at the base of this prong engages a T-post stud. The slot 650 at the end of the other prong engages the T-post spine. In the fourth configuration, FIGS. 7D, 8D, the T-post side wings are each engaged by the slot 640 at the base of each prong and the T-post spine is engaged by the middle channel 670.

The fifth configuration, FIGS. 7E, 8E, is a mirror image if the third configuration. Finally, the sixth configuration is a mirror image of the second configuration.

The insulator can be made out of any material, or combination of materials, that provide sufficient insulation. In a preferred embodiment, the insulator is made out of various resins and injection molded with UV stabilized thermoplastics that have a high dielectric strength, e.g. HDPE, HEPE+PP and the like. It is understood that a general-purpose insulator be made of materials with a practical blend of favorable properties such as low expense, dielectric strength, flexibility, durability. On the other hand, materials can be modified to favor certain features over others for special purposes. For example, the insulators can have an increased durability at the expense of flexibility and cost.

What is claimed is:

1. An electric fence insulator device comprising:

a body that is generally semicircular, said body has a generally concave inner surface and a generally convex outer surface, said device inner surface contains structures configured to form a friction fit with a vertical fence post, and said device outer surface contains structures configured to hold a horizontal wire, wherein said outer surface structures comprise:

a horizontal groove traveling along a portion of the outer surface, said groove being formed between opposing first and second side walls, and a tooth attached to the first side wall and extending perpendicularly toward the second side wall, wherein said device will electrically insulate said horizontal wire from said vertical post when said horizontal wire is electrified.

2. The device as defined in claim 1 wherein said device is configured to form a friction fit with a vertical T-post.

3. The device as defined in claim 2 wherein the horizontal wire is selected from the group consisting of: aluminum steel, poly wire, poly rope wire and barbed wire.

4. The device as defined in claim 2 wherein the inner surface further comprises: two side regions and a middle region in between the two side regions, said two side regions each comprise a forward portion extending from the body and a rearward portion extending to the middle region, wherein the inner surface structures further comprise: two symmetric prongs extending out from both side region forward portions and continuing backward toward the middle region at an orientation roughly parallel to the device inner surface such that the prongs are spring loaded to engage a T-post to form a friction fit.

5. The device as defined in claim 4 wherein the two symmetric prongs each further comprise a slot located at an end of the prong that can engage a T-post and a slot located at a base of the prong that can engage a T-post.

6. The device as defined in claim 5 wherein said two symmetric spring loaded prongs are configured to engage both standard size T-posts, 1.25 mm and 1.33 mm.

7. The device as defined in claim 5 wherein said inner surface structures further comprise a pair of wings located in the middle region and extending out perpendicularly from the middle region to form a middle channel wherein the middle channel can engage a T-post.

8. The device as defined in claim 1 wherein said outer surface structures further comprise: a second side of said horizontal groove having a notch carved out to facilitate insertion of a horizontal wire beneath the tooth and into the groove.

9. The device as defined in claim 8 wherein said notch further comprises: a notch perimeter with a lip extending perpendicular to the second side wall of the horizontal groove and extending in a direction away from the first side wall of the horizontal groove such that said lip facilitates insertion of a horizontal wire beneath the tooth and into the groove.

10. A fencing system, suitable for electrified fencing, comprising:

the insulator device as defined in claim 1, a vertical fence post, and a horizontal wire, wherein the device, the post, and the wire are combined so that: the insulator device is attached to the vertical fence post, and the horizontal wire is attached to said insulator device, wherein the horizontal wire will be insulated from the vertical fence post such that an electrified fence will be created if the horizontal wire is electrified.

11. The fencing system as defined in claim 10 wherein the horizontal wire is selected from the group consisting of: aluminum steel, poly wire, poly rope wire and barbed wire.

12. The fencing system as defined in claim 10 further comprising insulator devices attached to the vertical posts that are the same as insulator devices attached to posts along a straight run.

* * * * *